US005452697A

United States Patent [19]

Sasaki et al.

[11] Patent Number: 5,452,697

[45] Date of Patent: Sep. 26, 1995

[54] CONTROL ARRANGEMENT OF THROTTLE VALVE OPERATION DEGREE FOR AN INTERNAL COMBUSTION ENGINE

[75] Inventors: Yasushi Sasaki, Urizura; Yoshikatu Hashimoto; Teruhiko Minegishi, both of Katsuta; Tatsuya Yoshida, Urizura; Mitsuru Kon'i; Norihiro Isozaki, both of Katsuta, all of Japan

[73] Assignees: Hitachi, Ltd.; Hitachi Automotive Engineering Co., Ltd., both of Japan

[21] Appl. No.: 122,629

[22] Filed: Sep. 17, 1993

[30] Foreign Application Priority Data

Sep. 17, 1992 [JP] Japan ..... 4-247581

[51] Int. Cl.[6] ..... F02D 41/00

[52] U.S. Cl. ..... 123/399; 123/361

[58] Field of Search ..... 123/361, 399; 73/116

[56] References Cited

U.S. PATENT DOCUMENTS

| | | | |
|---|---|---|---|
| 4,693,111 | 9/1987 | Arnold et al. | 73/118.1 |
| 4,762,108 | 8/1988 | de Concini | 123/488 |
| 4,893,501 | 1/1990 | Sogawa | 73/118.1 |
| 4,895,126 | 1/1990 | Nishimiya et al. | 123/585 |
| 4,901,695 | 2/1990 | Kabasin et al. | 123/399 |

FOREIGN PATENT DOCUMENTS

| | | |
|---|---|---|
| 3433585A1 | 6/1986 | Germany . |
| 3709028A1 | 9/1987 | Germany . |
| 3839721C2 | 5/1991 | Germany . |
| 63-49112 | 10/1988 | Japan . |

*Primary Examiner*—Noah P. Kamen

*Attorney, Agent, or Firm*—Evenson, McKeown, Edwards & Lenahan

[57] ABSTRACT

A throttle valve control arrangement for an internal combustion engine comprising: a throttle valve; an electrical motor for actuating the throttle valve; mechanical links for coupling and decoupling the electrical motor with the throttle valve; a throttle position sensor for detecting a position of the throttle valve; and a control unit which compares an output signal from the throttle position sensor representing a detected throttle position with a signal representing a target throttle valve opening degree and generates a feed-back control signal for the electrical motor based on the comparison result, wherein the throttle position sensor shows a first output voltage characteristic with respect to throttle valve opening degrees for a first region covering ISC and FIC and a voltage gradient of the first output voltage characteristic is selected larger than that of an unmodified output voltage characteristic of the throttle position sensor, thereby a high resolution of the throttle position sensor is obtained for the first region.

5 Claims, 5 Drawing Sheets

CONTROL ARRANGEMENT OF THROTTLE VALVE OPERATION DEGREE FOR AN INTERNAL COMBUSTION ENGINE

BACKGROUND OF THE INVENTION

1. Field of the Invention

The present invention relates to an arrangement for controlling throttle valve opening for an internal combustion engine, and, in particular, to a control arrangement for an automobile engine having an actuator for opening and closing a throttle valve, a detector for detecting a controlled position of the throttle valve and a control unit which compares an output from the detector with a controlled target opening of the throttle valve, and feed-back controls for adjusting the opening of the throttle valve based on the comparison result, thereby controlling the opening of the throttle valve with a degree of high accuracy.

2. Description of Related Art

These days, in place of a conventional control arrangement for throttle valve opening wherein the throttle valve is directly operated by depression of an acceleration pedal, a control arrangement of throttle valve opening for an internal combustion engine used in a motor vehicle such as an automobile, a so called electronic throttle control arrangement of throttle opening has drawn attention in which a control input of the acceleration pedal is detected by a sensor in a form of electrical signal which is treated in accordance with a predetermined processing operation, and supplied to an actuator such as an electric motor that controls the opening of a throttle valve based on the processed electrical signal. The so called electronic throttle control arrangement of the throttle opening has been applied to many kinds of engine controls such as a traction control which is effective for enhancing performance of an automobile such as engine output enhancement.

Other than the above exemplified engine control, the so called electronic throttle control arrangement of the throttle opening can be applied for an idle speed control (ISC) and a fast idle control (FIC) in a region of a low throttle valve opening.

However, in a conventional ISC arrangement as, for example, disclosed in JP-B-63-49112(1988) which corresponds to U.S. Pat. No. 4,895,126, control of the idling rpm of an engine of a motor vehicle to a predetermined level in accordance with the temperature of water or an electric load has been effected by providing a bypass passageway to a throttle chamber for bypassing the throttle valve so as to regulate the volume of air flowing through the bypass passageway by ulilizing the pressure differential between the inlet and the outlet of the throttle valve.

Likely, in a conventional FIC arrangement, through a provision of an air regulator in a similar bypassing passageway, the volume of air flowing therethrough during a low temperature starting-up period is regulated.

In the conventional arrangements, auxiliary devices were indispensable for the ISC and FIC, and it was thus difficult to suppress the total leakage air amount. Therefore, when lowering of set idling rpm is required, it was necessary to modify the fundamental structure of the arrangements. Further, was difficult to reduce the manufacturing cost due to necessity of the auxiliary devices.

On the other hand, when control of a throttle valve in a region of low throttle valve opening is effected by the electronic throttle control arrangement, it was difficult to achieve a stable engine rpm during ISC and FIC engine controls because of an insufficient control accuracy of the arrangement due to a poor resolution of a throttle valve position sensor in a region of low throttle valve opening degrees.

SUMMARY OF THE INVENTION

An object of the present invention is to provide a simple electronic throttle type control arrangement of throttle valve opening for an internal combustion engine which achieves a sufficient control in a region of low throttle valve opening.

In the electronic throttle control arrangement according to the invention, an output voltage from a throttle position sensor representing actual opening of the throttle valve is compared with a target opening and a resultant actuating signal is transmitted to an electric motor for actuating the throttle valve to thereby effect a feed-back control of the throttle valve opening.

The comparison of the output voltage from the throttle position sensor with a target opening and the generation of a resultant feed-back control signal are usually performed by a microcomputer included in a control unit, and a control accuaracy of the feed-back control is determined by a resolution of the throttle position sensor and an A/D conversion capacity of the microcomputer which converts the output voltage in an analogue value from the throttle position sensor to a digital value.

Accordingly, the above object of the present invention is achieved at first by modifying the output voltage from the throttle position sensor representing an actual opening of the throttle valve in a region of low throttle valve opening degree in which a high control accuracy in needed and thereafter the modified output voltage is compared with a target opening degree.

The output voltage signal from the throttle position sensor is inputted to the control unit it is compared with a target opening valve and a feed-back control signal is generated based upon the comparison result. The feed-back control signal is transmitted to the electric motor for actuating the throttle valve to effect a feed-back control for the throttle valve.

Further, during any period of interruption of the electric motor control, an output voltage signal from the throttle position sensor and an output voltage signal from an acceleration pedal position sensor, which show a predetermined principal correlation each other, are inputted to the control unit wherein normal operation of the sensors is determined, to perform a fail safe control function.

In contrast to a linear output voltage characteristic of a conventional throttle position sensor, the output voltage characteristic of the throttle position sensor according to the present invention shows a switchable two output voltage characteristics wherein a first output voltage characteristic has a larger inclination covering a region of a low throttle valve opening which necessitates a high control accuracy, and a second output voltage characteristic has a smaller inclination than that of the first output voltage characteristic covering a region other than the low throttle valve opening degree. The first output voltage characteristic having a larger inclination is obtained by modifying the output voltage from the throttle position sensor through amplification.

Other objects, advantages and novel features of the present invention will become apparent from the following detailed description of the invention when considered in conjunction with the accompanying drawings.

DETAILED DESCRIPTION OF THE EMBODIMENTS

Hereinbelow, the throttle valve control arrangement for an internal combustion engine according to the present invention is explained in detail with reference to the embodiments.

Figure 1:
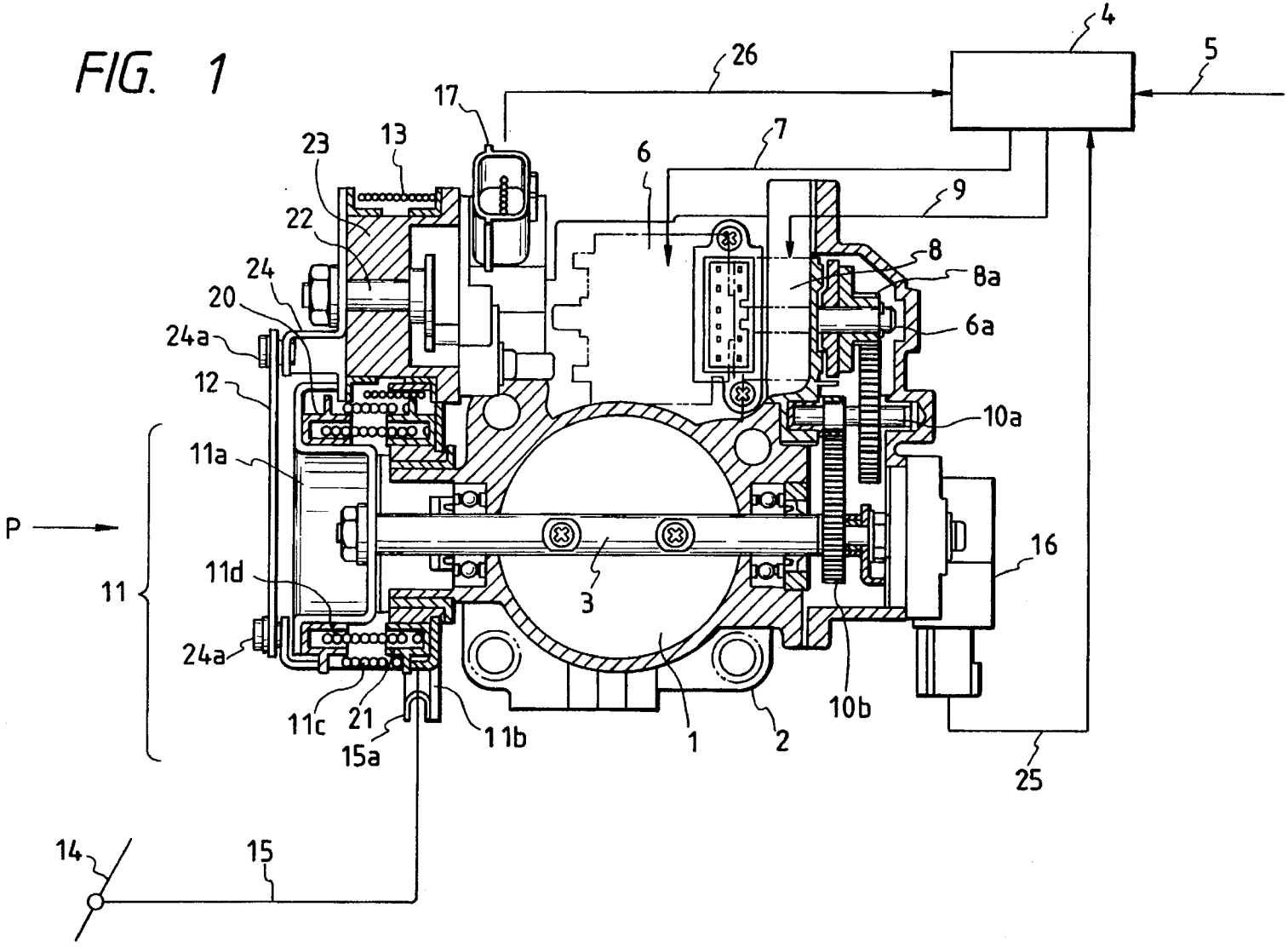
FIG. 1 is a system diagram including a detailed cross sectional view of a throttle valve arrangement of a throttle valve control arrangement for an internal combustion engine incorporating one embodiment of the present invention.
Figure 2:
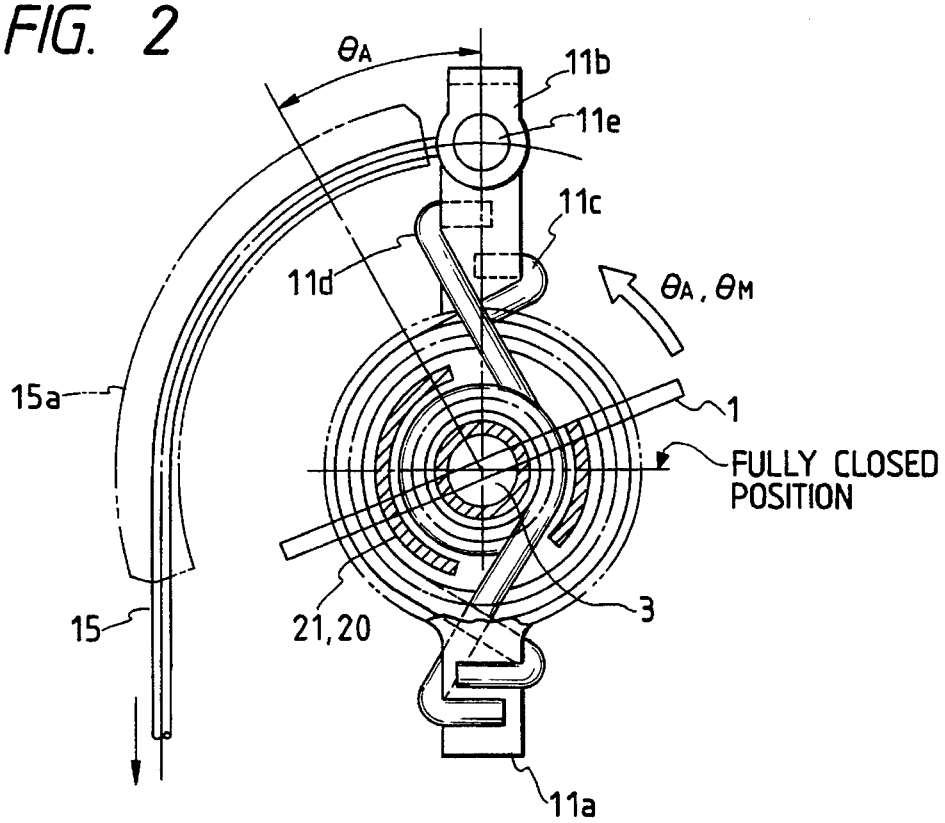
FIG. 2 is a view seen from the arrow P in FIG. 1 illustrating a spring actuating force transmitting mechanism included in the throttle valve arrangement as shown in FIG. 1.
Figure 3:
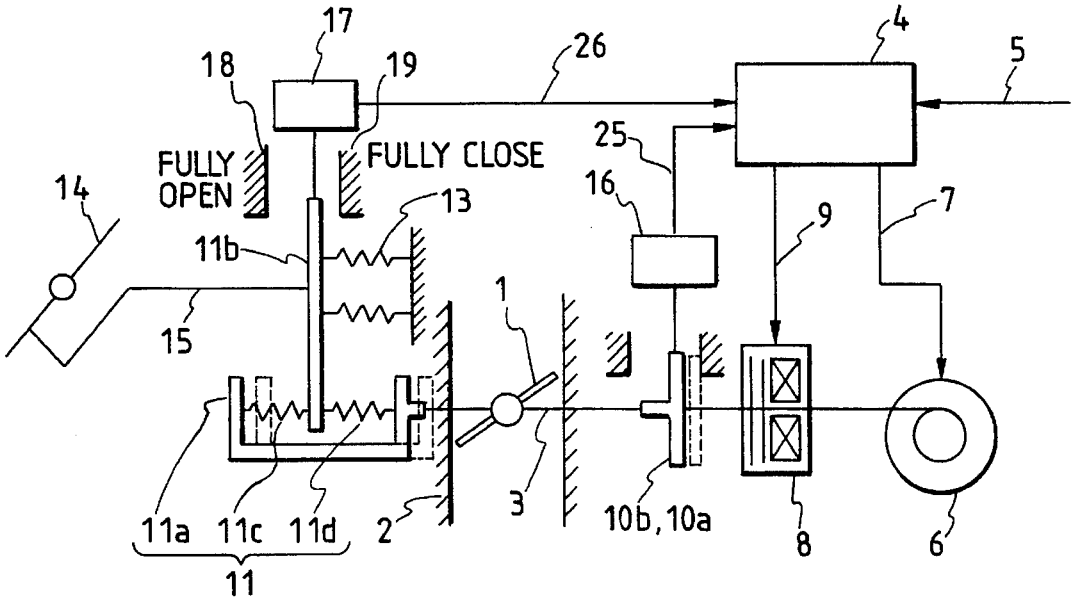
FIG. 3 is a schematic fuctional block diagram of the throttle valve control arrangement as shown in FIG. 1 for explaining the operation thereof.

In FIG. 1 through FIG. 3, numeral 1 is a throttle which is secured to a throttle valve axis 3 rotatably supported by a throttle body 2.

Numeral 4 is a control unit and numeral 6 is an electrical motor constituting an actuator for controlling throttle valve opening. The control unit 4 receives a target throttle valve opening signal 5 which is determined based on several data representing the instant engine opening condition, and outputs an actuating signal 7 to the electrical motor 6 after comparing with the target throttle valve opening degree signal 5.

Numeral 8 is an electro-magnetic clutch which is activated in response to an exciting signal 9 from the control unit 4 and serves as an actuating force coupling and decoupling means, which controls transmission of an actuating force between the throttle valve axis 3 and the electrical motor 6.

An input side gear 8*a* with a clutch plate for the electromagnetic clutch 8 is mounted on a motor shaft 6*a* in such a manner as to permit free rotation thereon, but is constituted to rotate as one body with the motor shaft 6*a* when the electro-magnetic clutch 8 is excited by the exciting signal 9. Thereby, an actuating force from the electrical motor 6 is transmitted to the throttle valve axis 3 via a reduction gear 10*a* engaging with the input side gear 8*a* and another reduction gear 10*b* secured on the throttle valve axis 3.

Numeral 11 is a spring actuating force transmitting mechanism which is constituted by a control lever 11*a* fixed to the throttle valve axis 3, a throttle lever 11*b* linked to an acceleration pedal 14 via an acceleration wire 15, and two springs 11*c* and 11*d* for inducing lost motion. The control lever 11*a* and the throttle lever 11*b* are coupled each other via the two springs for lost motion 11*c* and 11*d*.

Further, for the throttle lever 11*b* a return spring 13 is applied via a lever 12, thereby the throttle valve 1 is always forced in its closing direction.

Numeral 16 is a throttle position sensor which is designed to detect the extent of actual opening of the throttle valve 1 and numeral 17 is an acceleration pedal position sensor which is designed to detect an operating position of the throttle lever 11*b*.

Further, the throttle lever 11*b* also limits the range of rotatable throttle valve 1 in corporation with a fully open stopper 18 and a fully close stopper 19 (not shown in FIG. 1 but schematically illustrated in FIG. 3).

Numerals 20 and 21 are spring carriers made of a material having a small friction coefficient such as synthetic resins which carry the springs for lost motion 11*c* and 11*d* to thereby reduce a sliding resistance caused by these springs.

Numeral 22 is an acceleration pedal position sensor axis which is inserted and supported by a sensor housing 23 in a manner permitting a free rotation thereof and to which a lever 24 is fixed. The lever 24 is linked to the throttle lever 11*b* via connecting pins 24*a* and lever 12. Accordingly, the lever 24 rotates in accordance with the rotation of the throttle lever 11*b*, thereby the rotation of the throttle lever 11*b* is transmitted to the acceleration pedal position sensor 17.

Further, since the return spring 13 is provided around the acceleration pedal position sensor axis 22, a play possibly existing in the above rotating movement transmitting links is eliminated.

As illustrated in FIG. 1 and FIG. 3, an output voltage signal 25 from the throttle position sensor 16 is inputted to the control unit 4 where it is compared with a target opening degree signal 5 and the actuating signal determined based on the comparison result is transmitted to the electrical motor 6, thereby a feed-back control of the throttle valve 1 is effected.

Further, during an interruption of a control by the electrical motor 6, an output voltage signal 25 from the throttle position sensor 16 and an output voltage signal 26 from the acceleration pedal position sensor 17, which show a predetermined principal correlation each other, are inputted to the control unit 4 wherein normal operation of the sensors is determined to perform a fail safe control function.

However, the fail safe control logic explained above is merely an example, a fail safe control logic to be incorporated in the present invention is not limited thereto.

FIG. 2 is a schematic diagram of the spring actuating force transmitting mechanism 11 viewed from the arrowed direction P in FIG. 1, wherein the throttle valve 1 as well as the control lever 11*a* are secured to the throttle valve axis 3 so that the control lever 11*a* rotates as one body with the throttle valve 1.

On the other hand, the throttle lever 11*b* is supported on the throttle valve axis 3 in a manner permitting a free rotation thereof and the springs for lost motion 11*c* and 11*d* are assembled on the spring carriers 20 and 21 in such a manner that the directions of spring forces exterted by the respective springs for lost motion 11*c* and 11*d* are opposing each other, thereby these springs 11*c* and 11*d* act to provide displacements in opposite direction to the throttle lever 11*b*.

Further the respective springs 11*c* and 11*d* are assembled in a pretensioned condition.

The acceleration wire 15 is secured via a wire guide 15*a* to the throttle lever 11*b* at a slinging portion 11*e* so that through an operation of the acceleration pedal 14, the throttle lever 11*b* causes the throttle valve 1 to rotate in the arrowed direction $\theta_A$ against the stored spring force of the return spring 13 when the electro-magnetic clutch 8 is decoupled from the motor shaft 6*a*.

Now the operation of the throttle valve control arrangement as illustrated in FIG. 1 and FIG. 2 is explained with reference to FIG. 3 which illustrates a schematic functional diagram of the arrangement shown in FIG. 1 and FIG. 2.

In FIG. 3, the rotating movement in the arrangement in FIG. 1 and FIG. 2 is represented by a linear movement for facilitating the understanding of the operation of the arrangement, and further, the same reference numerals as in FIG. 1 and FIG. 2 depict the same or equivalent portions as in FIG. 1 and FIG. 2.

In FIG. 3, when the vehicle driver turns on a key switch (not shown), the exciting signal 9 is transmitted simmultaneously to the electro-magnetic clutch 8 to render the same an on condition, thereby the throttle valve control arrangement is brought into a condition ready to perform the control operation. When an actuating signal 7 is transmitted from the control unit 4 to the electrical motor 6, the opening of the throttle valve 1 is controlled accordingly. At this moment, the control lever 11*a* fixed to the throttle valve axis 3 moves (rotates) as one body with the throttle valve 1 in accordance with the rotation of the electrical motor 6 as indicated by a broken line. A relative displacement of the throttle lever 11*b* induced by the movement (rotation) of the control lever 11*a* is absorbed, however, by an extension of one of the springs for lost motion 11*c* and 11*d* and by contraction of the other (in FIG. 1 embodiment, an uncoiling of one and a coiling of the other), as a result, independent from an operating position of the throttle lever 11*b* which is determined in accordance with the extent of depression of the acceleration padal 14, a control of throttle valve operating degree is performed by the electric motor 6, in other words, an operation of an electric throttle mode is obtained.

Now, when an abnormal condition such as a failure in the motor actuating system occurs by some reasons, at first, the excitation of the electro-magnetic clutch 8 is terminated through an activation of an abnormality judgement function incorporated in the control unit 4 to render the electro-magnetic clutch 8 in an off condition and thus the throttle valve axis 3 is decoupled from the electrical motor 6 and freed therefrom.

At this moment, when it is further assumed that there has been a relative displacement between the throttle lever 11*b* and the control lever 11*a*, there exists a difference in stored spring force between the springs for lost motion 11*c* and 11*d*, therefore the control lever 11*a* is caused to move (rotate) by an action of these springs 11*c* and 11*d* to a position where the difference in stored spring force balances, namely to a position where the relative dispacement becomes zero, and thus the throttle valve 1 is forced to move (rotate) to a position corresponding to the operating position of the acceleration pedal 14.

As a result, a condition is completed wherein the throttle valve axis 3 only couples to the acceleration pedal 14 via the control lever 11*a*, the springs for lost motion 11*c* and 11*d* and the throttle lever 11*b*, namely a condition is readied wherein the throttle valve 1 can only be actuated by the acceleration pedal 14.

After the above condition has been completed, and when the acceleration pedal 14 is depressed, the throttle lever 11*b* is rotated against the restoring force of the return spring 13, and in response to the movement (rotation) of the throttle lever 11*b* a force required for balancing the stored spring forces of the springs for lost motion 11*c* and 11*d* is acted on the control lever 11*a*, thereby the control lever 11*a* follows the movement of the throttle lever 11*b* with a predetermined phase relationship to perform a control of throttle valve opening degree, in other words, a limp home function of the throttle valve control arrangement is obtained.

Figure 4:
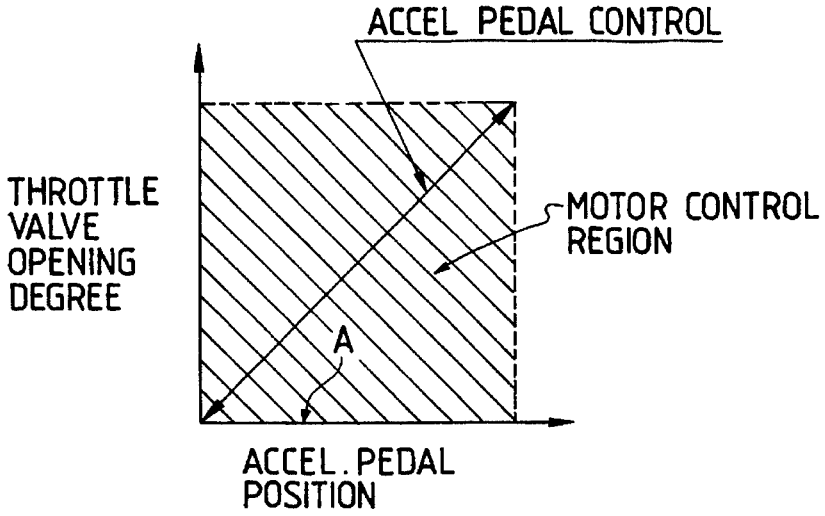
FIG. 4 is a diagram for explaining a region of controllable throttle valve opening degree with respect to acceleration pedal stroke obtained by making use of the throttle valve control arrangement as shown in FIG. 1.

FIG. 4 shows a controllable throttle valve opening with respect to acceleration pedal stroke of the throttle valve control arrangement shown in FIG. 1 embodiment.

During a control of the throttle valve 1 with the electrical motor 6, any throttle valve opening values can be taken for respective acceleration strokes as illustrated by a hatched region, while during a limp home mode of operation, a single throttle valve opening degree is determined for the respective acceleration pedal strokes as in a conventional arrangement as indicated by a solid linear characteristic line.

Therefore, according to FIG. 1 embodiment, at an occurrence of abnormal condition the electrical motor 6 is disconnected from the throttle valve axis 3 and the throttle valve control is automatically shifted to the throttle valve opening degree control through the acceleration pedal 14 and the opening degree of the throttle valve 1 is determined depending upon an operating position of the acceleration pedal 14 to provide a limp home function and at this moment, the position of the throttle valve 1 is returned to a position determined by the operating position of the acceleration pedal 14 so that serious accidents such as a runaway in a limp home condition is reliably suppressed and a satisfactory fail safe function and a high reliability are realized.

Figure 5:
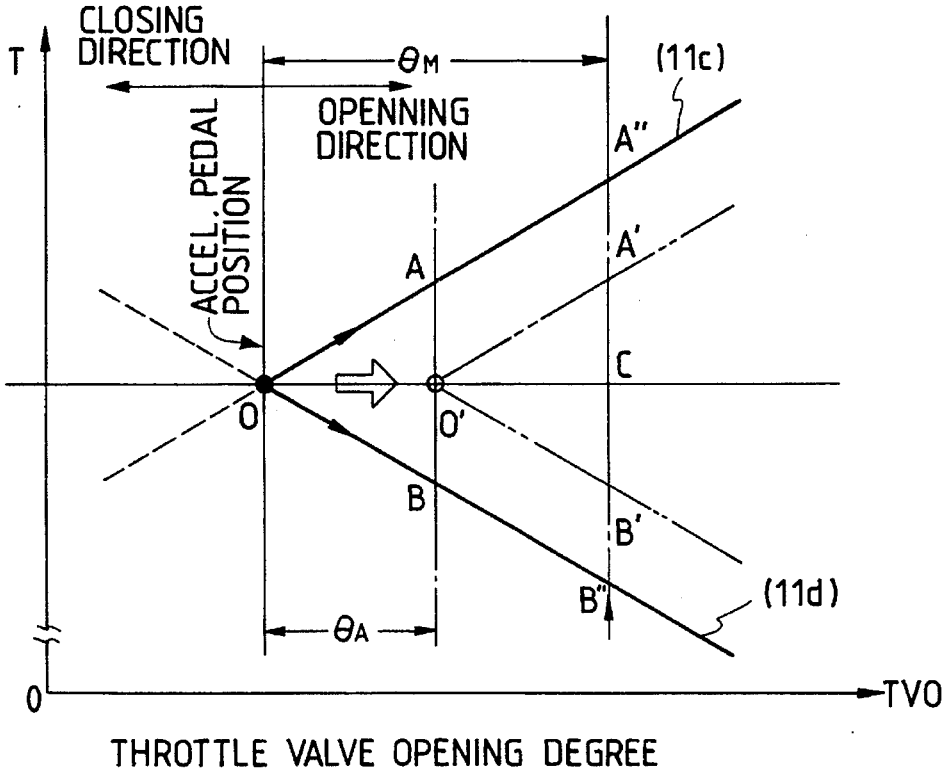
FIG. 5 is a diagram for explaining the function of the spring actuating force transmitting mechanism as shown in FIG. 2.

FIG. 5 is a schematic diagram for explaining operations of the spring actuating force transmitting mechanism 11 during a control by the electrical motor 6 and during a control by the acceleration pedal 14. The abscissa of the cordinate system in FIG. 5 represents throttle valve opening degree TVO and the ordinate thereof represents stored torque T of the springs for lost motion 11*c* and 11*d*.

In the drawing, point O represents a neutral (or initial) condition wherein the throttle valve opening degree TVO coincides with a position corresponding to the operating position of the acceleration pedal 14.

Now, when the throttle valve 1 is controlled by the electrical motor 6 to move in its opening direction by an angle of $\theta_M$ deg., the spring for lost motion 11*c* is rotated in its coiling direction the spring for lost motion 11*d* is rotated in its uncoiling direction. Namely, characteristic O-A" in FIG. 5 shows a variation of stored torque T in the spring 11*c* and characteristic O-B" shows a variation of stored torque T in the spring 11*d*. An absolute value A"–B" represents a necessary torque to be generated by the electrical motor 6.

The control of the throttle valve 1 in its opening direction is explained above, however the same is true for the control in its closing direction.

Now, an instance wherein a limp home mechanism by the spring actuating force transmitting mechanism 11 is activated from the point O in FIG. 5 is explained.

Assuming that the throttle lever 11*b* is rotated in its opening direction by an angle of $\theta_A$ deg. through the operation of the acceleration pedal 14, the control lever 11*a* rotates in the same rotating direction as the throttle lever 11*b*, thus maintaining the balanced condition of the stored torque T in the respective springs 11*c* and 11*d*; thereby the neutral point of the springs 11*c* and 11*d* is shifted from the point O to a point O' and the throttle valve 1 is rotated to the opening direction by the same angle of $\theta_A$ deg. Accordingly, even when an abnormal condition occurs in the actuating system including the electrical motor 6, the limp home function is reliably started.

When a throttle valve control by an actuator such as the electrical motor 6 is performed without provision of such as a clutch at the side of the acceleration pedal 14 as in the present embodiment, a kick-back phenomenon usually appears on the acceleration pedal 14.

However, in the present embodiment, the two springs 11*c* and 11*d* are used as the springs for lost motion and are assumbled in such a manner that the directions of their stored torques oppose each other, accordingly, when same storing torque constants of these springs 11*c* and 11*d* with respect to the throttle valve axis 3 are selected, a flat composite torque characteristic O-C of these springs as illustrated in FIG. 5 is obtained and the kick-back phenomenon is eliminated thereby.

Now, when it is required to perform such as ISC function and FIC function with the electronic throttle type throttle valve control arrangement as explained in the above, it is necessary to enhance a control accuracy of the arrangement by increasing the resolution of the throttle position sensor included therein so as to achieve a stability of the engine rpm during ISC and FIC.

Accordingly, hereinbelow, measures for increasing a resolution of the throttle position sensor in order to improve the control accuracy of the throttle valve control arrangement according to the present invention are explained.

Figure 6:
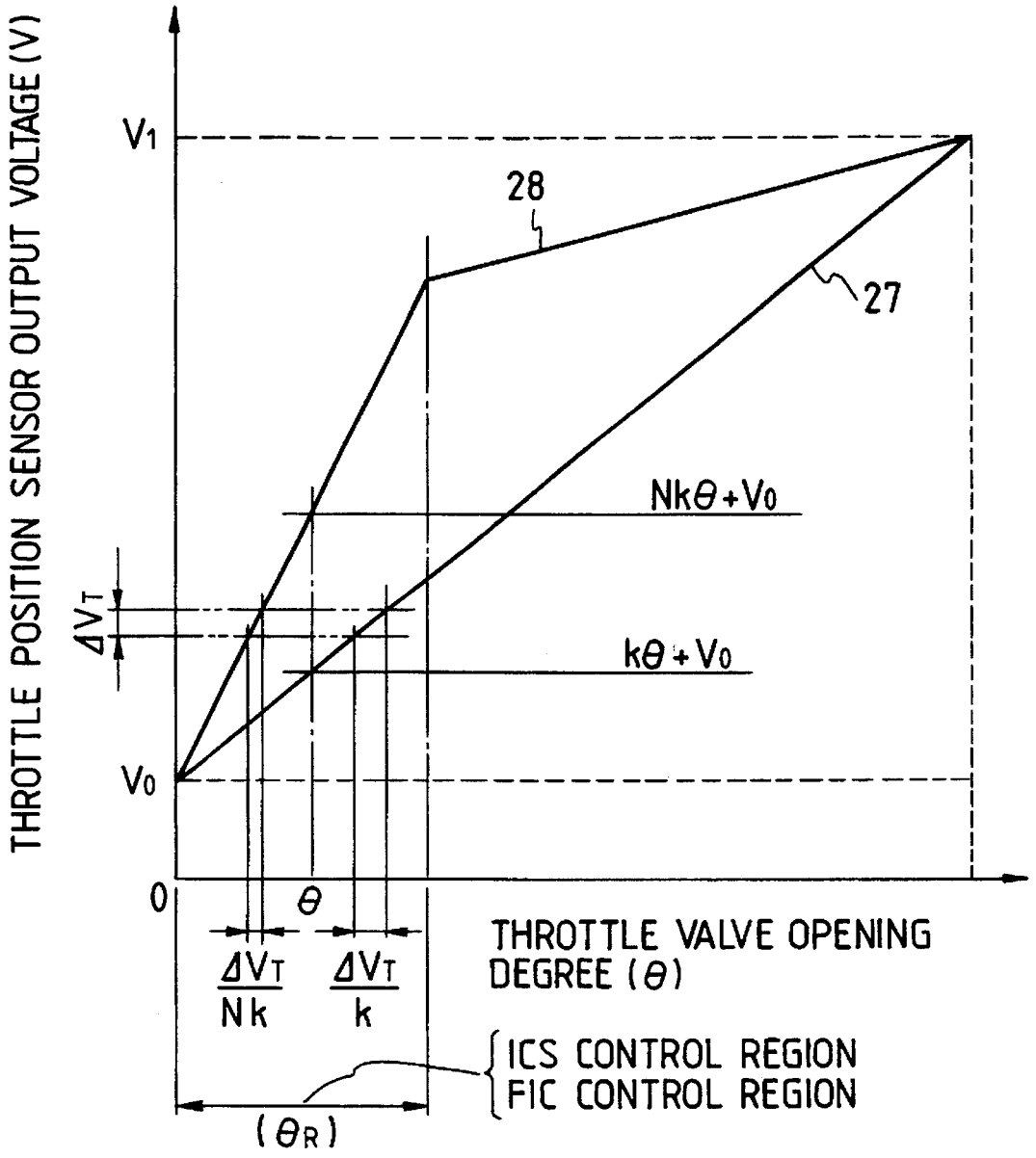
FIG. 6 is a diagram illustrating an output voltage characeristic of a throttle position sensor incorporated in the throttle valve control arrangement as shown in FIG. 1.

FIG. 6 shows an example for increasing resolution of the throttle position sensor wherein the slope of the output voltage characteristic of the throttle position sensor 16, which is designed to detect a controlled actual opening degree of the throttle valve 1, is increased for a region $\theta_R$ of throttle valve opening degree (ISC control region and FIC control region) which necessiates a high control accuracy, thereby a control accuracy of the throttle opening degree feed-back control with the electrical motor is improved.

A solid line 27 represents an unmodified output voltage characteristic of the throttle position sensor 16, and the characteristic of the output voltage (V) on the oridinate with respect to throttle opening degree (θ) on the abscissa shows a linear characteristic having a fixed voltage constant k. In contrast thereto, a solid line 28 represents an output voltage characteristic of the throttle position sensor 16 incorporated in the throttle valve control arrangement as shown in FIG. 1, in which, the voltage constant of the output voltage characteristic in the ISC and FIC control regions which necessitate a high control accuracy is N times larger than that of the unmodified output voltage characteristic 27.

A minimum detectable output voltage unit $\Delta V_T$ of the throttle position sensor, which determines the resolution of the throttle position sensor and the control acuracy for the throttle valve opening degree feed-back control, is defined by an output voltage range $(V_I-V_O)$V and A/D conversion processing capacity of B bits of a microcomputer and expressed as $\Delta V_T=(V_I-V_O)/B$.

When the unmodified output voltage characteristic 27 of the throttle position sensor 16 is used, a minimum detectable unit of throttle opening degree (in other words a resolution, corresponding to the voltage unit) is $\Delta V_T/k$ deg. On the other hand, when the output voltage characteristic 28 of the throttle position sensor 16 is used, a minimum detectable unit of throttle opening degree (a resolution, corresponding to the voltage unit $\Delta V_T$ for the region $\theta_R$ of low throttle opening degrees) is increased to $\Delta V_T/Nk$ deg. Accordingly, by multiplying the output voltage constant k of the throttle position sensor by N times for the region $\theta_R$ of low throttle opening degrees, the resolution of the throttle position sensor (in other words, the control accuracy of the throttle valve control arrangement) is improved by N times. As a result, a stability of engine rpm during ISC and FIC is achieved.

Figure 7:
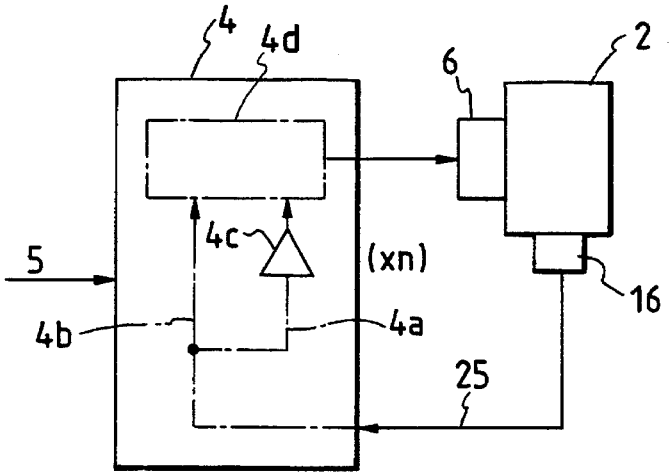
FIG. 7 is a schematic block diagram of another embodiment of throttle valve control arrangements for an internal combustion engine according to the present invention.
Figure 8:
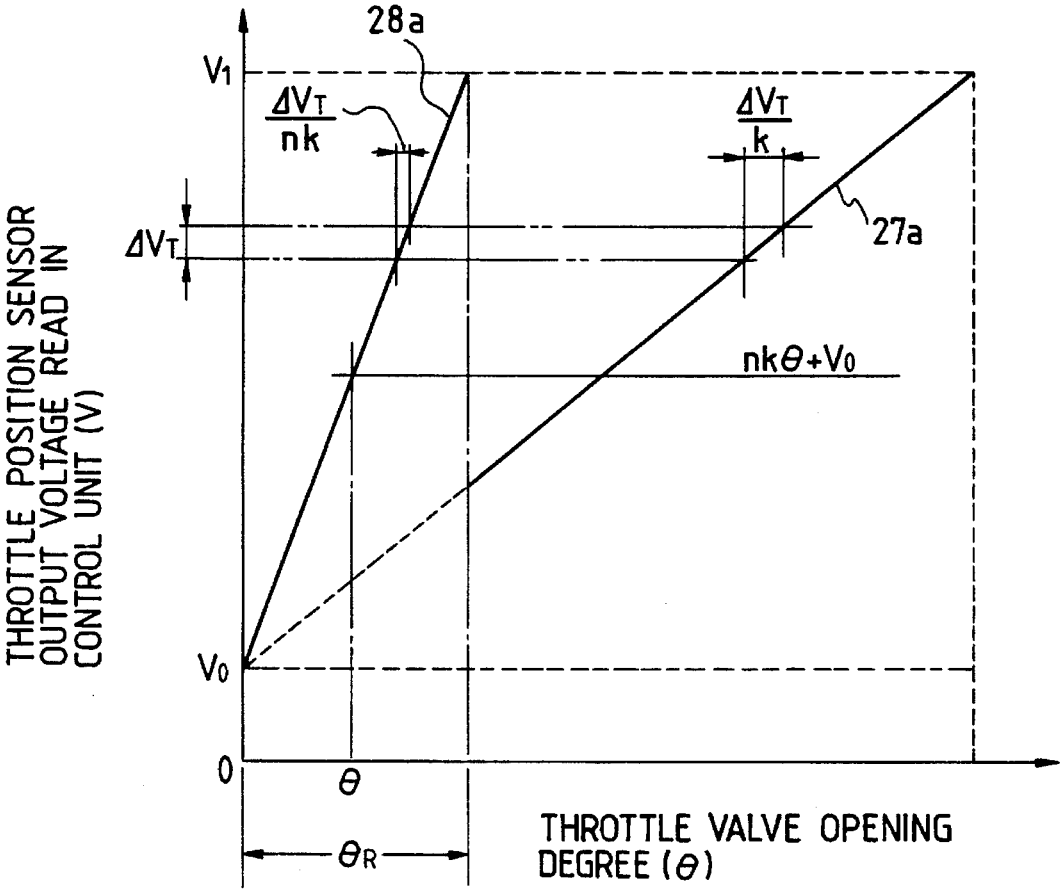
FIG. 8 is a diagram illustrating an output voltage characteristic of a throttle position sensor incorporated in the throttle valve control arrangement as shown in FIG. 7.

FIG. 7 and FIG. 8 are diagrams for explaining another embodiment according to the present invention, wherein when the throttle valve 1 is controlled in the region $\theta_R$, necessitating a high control accuracy, the output voltage 25 from the throttle position sensor 16 detecting a controlled actual opening degree is amplified by n times via an amplifier 4*c* included in the control unit 4. Thus, the control accuracy of the feed-back control of the throttle valve opening degree is improved by making use of the electrical motor 6 as the actuator therefor.

FIG. 7 is a schematic block diagram of the throttle valve control arrangement according to the present invention, and FIG. 8 shows an output voltage characteristic (V) on the ordinate of the throttle position sensor 16 incorporated in FIG. 7 embodiment with respect to throttle opening degree (θ) on the abscissa which is used in a processing unit 4*d* in the control unit 4. In the region $\theta_R$ (small throttle valve opening), the output voltage 25 from the throttle position sensor 16 is read in the processing unit 4*d* via an time amplifier which has a gain of n. Accordingly, an output voltage characteristic 28*a* having a voltage constant of n times larger than the voltage constant k for the unmodified output voltage characteristic 27*a* is obtained for the region $\theta_R$ of low throttle valve opening degree.

Outside the region $\theta_R$ (large throttle valve opening), the output voltage 25 from the throttle position sensor 16 is directly read in the processing unit 4*d* without amplification in amplifier 4*c*; the unmodified output voltage characteristic 27*a* having the voltage constant k is thus used for the region outside the region $\theta_R$. As a result, like the previous embodiment, a minimum detectable unit of throttle valve opening corresponding to the minimum detectable output voltage unit $\theta V_T$ is $\theta V_T/nk$ deg. for the region $\theta_R$ (small throttle valve opening) and that for the region of large throttle valve opening degrees is $\Delta V_T/k$ deg.

Accordingly, since the output voltage 25 from the throttle position sensor 16 is read and amplified by a factor of n in the time amplifier 4*c* in the region $\theta_R$ opening degrees to increase the voltage constant k of the unmodified output voltage characteristic by n time, the resolution of the throttle position sensor, in other words, the control accuracy of the throttle valve control arrangement is improved by n times, and a stability of engine rpm during ISC and FIC is achieved.

According to the present invention, a throttle valve control arrangement is provided which meets a demmand of reducing a set idling rpm by suppressing a total leakage air amount through elimination of the conventional auxiliary devices and improves the control accuracy thereof in the region of low throttle valve opening degrees with a simple measure and a low manufacturing cost.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A control arrangement for a throttle valve in an internal combustion engine comprising:

an electric motor coupled to drive said throttle valve;

a throttle position sensor unit for detecting actual position of said throttle valve and generating an actual position signal indicative thereof;

an amplifier connected to receive said actual position signal and to generate an amplified actual position signal having a magnitude equal to a multiple of said actual position signal;

means for generating a command position signal indicative of a desired position of said throttle valve;

comparing means for comparing said amplified actual position signal with said command position signal when said actual throttle position falls within a lower range, having a value less than a predetermined threshold level, and for comparing said actual position signal with said command position signal when said actual throttle position falls within an upper range having a value greater than said predetermined threshold level; and means for controlling operation of said electric motor in response to an output of said comparing means;

whereby resolution of said throttle position sensor in said lower range is increased relative to that of said upper range, without diminishing resolution of said throttle position sensor in said upper range.

2. Method of controlling a throttle valve of an internal combustion engine, said throttle valve being driven by an electric motor, said method comprising the steps of:

generating a command position signal indicative of a desired position of said throttle valve;

detecting an actual position of said throttle valve, and generating an actual position signal indicative thereof;

amplifying said actual position signal to generate an amplified actual position signal equal to a multiple of said actual position signal;

comparing said command position signal with said actual position signal when said actual throttle position is below a predetermined threshold level, and with said amplified actual position signal when said actual throttle position exceeds said predetermined threshold level, and generating an actuating signal based on results of said comparison; and controlling operation of said electric motor in response to said actuating signal.

3. For use with a throttle valve control device for an internal combustion engine, said throttle valve control device being of the type wherein an output of a throttle position sensor unit is compared with an input command position signal to drive an electric motor which controls position of said throttle valve, and wherein said throttle position sensor unit generates an actual position signal according to an output characteristic relative to actual position of said throttle valve, which output characteristic comprises lower and upper regions, said lower region including actual positions of said throttle valve providing a throttle valve opening which is less than a predetermined threshold level, wherein said characteristic has a first voltage gradient, and said upper region including actual positions of said throttle valve providing a throttle valve opening which is greater than said predetermined threshold, wherein said characteristic has a second voltage gradient which is smaller than said first voltage gradient, said method comprising the steps of:

generating said first voltage gradient by amplifying said actual position signal by means of an amplifier having a gain greater than 1.0; and generating said second voltage gradient by passing through said actual position signal, without amplification;

whereby resolution of said throttle position sensor in said lower region is increased relative to that of said upper region without diminishing resolution of said throttle position sensor in said upper region.

4. A control arrangement for a throttle valve in an internal combustion engine comprising:

an electric motor for actuating said throttle valve;

a throttle position sensor unit for detecting actual position of said throttle valve and generating an actual position signal indicative thereof;

means for generating a command position signal indicative of a desired position of said throttle valve;

means for comparing said actual position signal and said command position signal; and means for controlling operation of said electric motor in response to an output signal from said means for comparing;

wherein said throttle position sensor unit generates said actual position signal according to an output characteristic relative to actual position of said throttle valve, which output characteristic comprises lower and upper regions, said lower region including actual positions of said throttle valve providing a throttle valve opening which is less than a predetermined threshold level, and said upper region including actual positions of said throttle valve providing a throttle valve opening which is greater than said predetermined threshold; and wherein said throttle position sensor unit comprises:

means for generating a first position signal indicative of said actual position of said throttle valve;

an amplifier coupled to receive said first position signal and to output a second position signal having a value equal to a multiple of said first position signal; and a processing unit coupled to receive said first and second position signals and to output said actual position signal having a value equal to said second position signal in said lower region and equal to said first position signal in said upper region;

whereby said output characteristic has a first voltage gradient in said lower region, and a second voltage gradient smaller than said first gradient, in said upper region, and resolution of said throttle position sensor in said lower region is increased relative to that of said upper region without diminishing resolution of said throttle position sensor in said upper region.

5. A control arrangement according to claim 4, wherein the first region includes an idle speed control region and a fast idle control region.

* * * * *

UNITED STATES PATENT AND TRADEMARK OFFICE

CERTIFICATE OF CORRECTION

PATENT NO. : 5,452,697
DATED : September 26, 1995
INVENTOR(S) : Yasushi Sasaki, et al It is certified that error appears in the above-identified patent and that said Letters Patent is hereby corrected as shown below:

Column 9, lines 48-49, delete "is below a" and insert --exceeds--.

Column 9, line 51, delete "exceeds" and insert --is below--.

Signed and Sealed this

Nineteenth Day of November, 1996

Bruce Lehman

*Attest:*

BRUCE LEHMAN

*Attesting Officer*

*Commissioner of Patents and Trademarks*